US005102243A

United States Patent [19]

Ueno

[11] Patent Number: 5,102,243

[45] Date of Patent: Apr. 7, 1992

[54] PRINTING APPARATUS FOR PRINTING SAME SIZE RULED LINE WITHOUT REGARD TO PRINT PITCH SELECTION

[75] Inventor: Hideo Ueno, Nagoya, Japan

[73] Assignee: Brother Kogyo Kabushiki Kaisha, Nagoya, Japan

[21] Appl. No.: 564,558

[22] Filed: Aug. 9, 1990

[30] Foreign Application Priority Data

Nov. 20, 1989 [JP] Japan ..... 1-302635

[51] Int. Cl.[5] ..... B41J 29/26

[52] U.S. Cl. ..... 400/17; 400/76; 400/279; 400/306; 400/347

[58] Field of Search ..... 400/17, 16, 22, 61-62, 400/63, 65, 70, 76, 279, 283, 299, 347, 320, 306

[56] References Cited

U.S. PATENT DOCUMENTS

| | | | |
|---|---|---|---|
| 3,630,336 | 12/1971 | Johnson et al. | 400/17 |
| 4,084,680 | 4/1978 | Deetz | 400/17 |
| 4,615,631 | 10/1986 | Ueda et al. | 400/63 |
| 4,624,591 | 11/1986 | Barnes et al. | 400/347 |
| 4,749,289 | 7/1988 | Sugiura et al. | 400/22 |
| 4,808,016 | 2/1989 | Takahashi | 400/17 |
| 4,906,114 | 3/1990 | Tanaka et al. | 400/17 |
| 4,955,733 | 9/1990 | Ukon | 400/17 |
| 4,963,042 | 10/1990 | Kawakami et al. | 400/17 |

FOREIGN PATENT DOCUMENTS 2217886 11/1989 United Kingdom .

*Primary Examiner*—Eugene H. Eickholt
*Attorney, Agent, or Firm*—Oliff & Berridge

[57] ABSTRACT

In the print apparatus of this invention, a ruled line is formed on a print medium as a line-up of lines printed by plural printing operation with a line type. A carriage on which the printing unit including the line type is installed is moved from the position where the end of the ruled line composing the outline of a table, is located toward the center of the table at a half print pitch of maximum print pitch, irrespective of the print pitch set by an operator, when the edge of the ruled line is printed. And the ruled line is printed on the print medium by the operation of the printing unit. Moreover, when the middle size of type which can be used corresponding to various print pitches is installed on the carriage, the ruled line can be printed not to protrude from ruled line composing the outline contacting with this ruled line whatever print pitches are set.

19 Claims, 4 Drawing Sheets

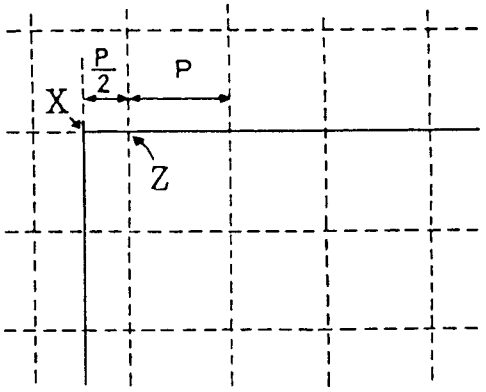
FIG.6 (A)
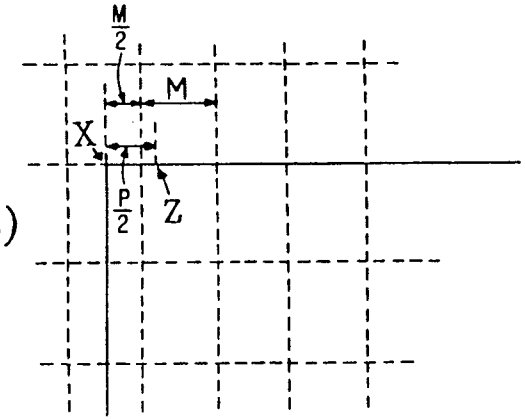
FIG.6 (B)
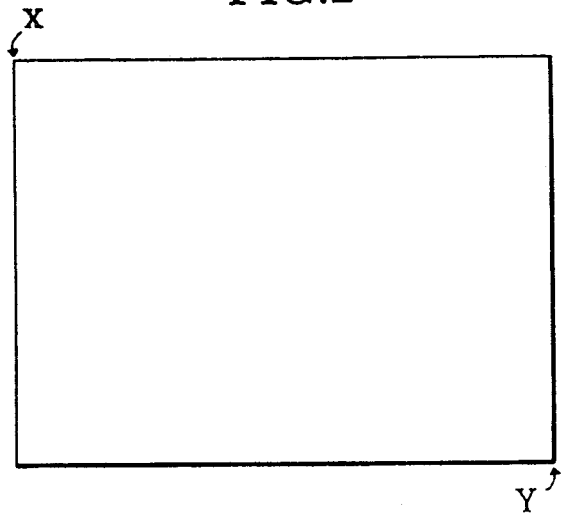
FIG.2
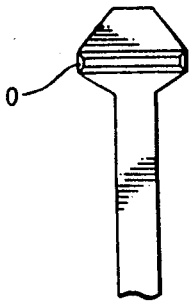
FIG.3 (B)
FIG.3(A)

PRINTING APPARATUS FOR PRINTING SAME SIZE RULED LINE WITHOUT REGARD TO PRINT PITCH SELECTION

BACKGROUND OF THE INVENTION

1. Field of the Invention

The present invention relates to a print apparatus that can change the print pitch, and specifically concerns a printer which can print the appropriate ruled line with each pitch.

2. Description of Related Art

There are currently many print apparatus that can select from a plurality of print pitches (ex. pica, elite, micron) and set one of them. To put it concretely, pica is 1/10 inches, elite 1/12 inches, micron is 1/15 inches. One character is printed at each print pitch. Many such apparatus can also print a ruled line. As an example of the print apparatus which has such a function, one such print apparatus has a detachable type wheel which has type for printing the ruled line. The type formed on this type wheel for printing the ruled line print the horizontal line segment shown in FIG. 3 (A) and the vertical line segment shown in FIG. 3 (B). A repeat function is used with the type of the vertical line segment or the horizontal line segment to move the type to each print position and print. The vertical ruled line or horizontal ruled line is printed by typing each printed segment. United Kingdom Patent Publication No. 2,217,886A laid open on Nov. 1, 1989 which corresponds to U.S. patent application Ser. No. 330,908 filed Mar. 31, 1989 and assigned to the same assignee as the present application, and U.S. Pat. No. 4,615,631 disclose changing print pitch by half at the edge of the ruled line for appropriate connection of the horizontal ruled line and the vertical ruled line.

However, in the print apparatus which can change print pitch, type of the size which corresponds to each print pitch is necessary. For instance, if a type wheel which does not correspond to the print pitch is used with the type wheel print apparatus, an appropriate ruled line was not able to be printed.

That is, each segment printed by the horizontal line type was not connected to each other, when the print pitch was wider than the width of the horizontal line type. Therefore, the horizontal ruled line became a dotted line. Moreover, the horizontal ruled line cannot be printed as a dotted line when the print pitch is narrower than the width of the horizontal line type. Also the horizontal ruled line passes through the vertical ruled line and extends beyond it where the horizontal ruled line touches the vertical ruled line because the type is larger than optimal.

In a conventional printing apparatus, an appropriate ruled line could not be printed as above-mentioned, if type which was suitable for the print pitch was not installed.

SUMMARY OF THE INVENTION

An object of the present invention is to provide a printing apparatus which can print an appropriate ruled line by type of the ruled line of the same size, whatever print pitch is set.

Another object of the present invention is to provide multi-pitch printing apparatus which can print an appropriate ruled line by using the same type, without replacing the type.

A further object of the present invention is to provide print apparatus which can print a horizontal ruled line ending at a vertical ruled line, for example to outline a table, without replacing type, irrespective of the print pitch set.

To achieve these objects, the printing apparatus of this invention has: print pitch selecting means which selects one print pitch from a plurality of print pitches; a carriage provided detachably with a unit line type for printing ruled lines by printing plural times and being supported for movement along a print line; a carriage drive means which moves the carriage at a print pitch set by print pitch selecting means; a pressure mechanism which presses the unit line type toward print medium; a control means which operates the pressure mechanism and prints a ruled line after the carriage is moved to an end of the ruled outline at one half the print pitch of maximum print pitch, whatever the print pitch set when the end of the ruled line is printed.

In the print apparatus of this invention, which has the above-mentioned constitution, the carriage is moved by the control means for the ruled line position composing the outline, inwardly only at a half print pitch of maximum print pitch, whatever print pitch is set by a print pitch set means, when the ends of the ruled line are printed. And the ruled line is printed on the print medium by the operation of the pressure mechanism.

In the print apparatus of this invention, an appropriate ruled line can be printed if the unit line type for maximum print pitch is used, irrespective of the print pitch set.

Moreover, the middle size type can be used whatever print pitch is set for the carriage. As a result, ruled lines can be printed which do not protrude beyond ruled line composing an outline formed by such lines touching the ruled line, whatever print pitch is set.

BRIEF DESCRIPTION OF THE DRAWINGS

A preferred embodiment of the present invention will be described in detail with reference to the following figures wherein:

FIG. 2 is a plan view showing a preferred form of the ruled line to be printed;

FIG. 3(A) shows a horizontal unit line type;

FIG. 3(B) shows a vertical unit line type;

FIG. 6(A) and 6(B) are diagrams showing relations between print pitches and print results at edges of ruled lines.

DETAILED DESCRIPTION OF THE PREFERRED EMBODIMENT

Hereinafter an embodiment which embodies a typewriter according to the present will be described with references to FIGS. 1 through 6.

Figure 1:
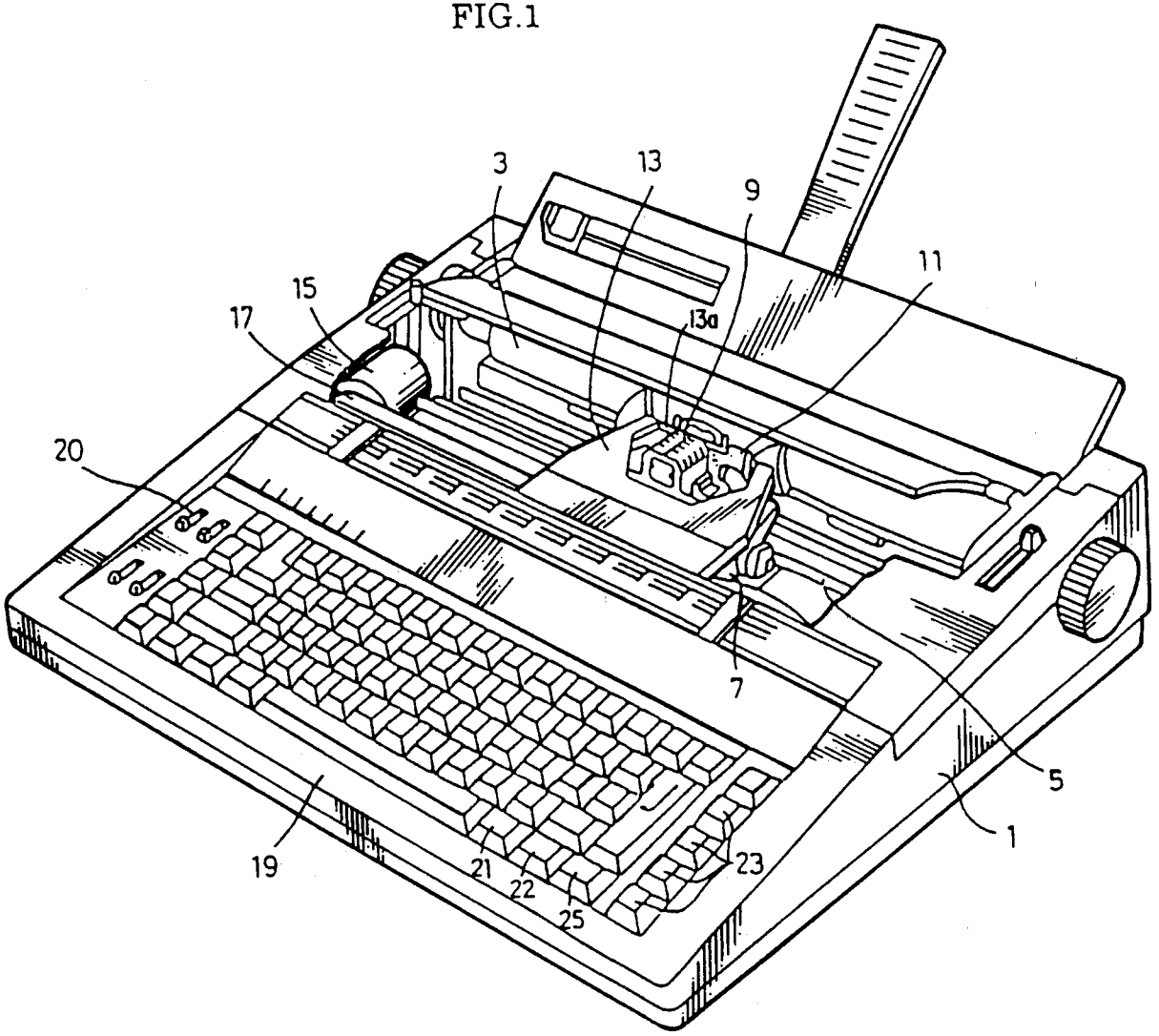
FIG. 1 is a perspective view showing the typewriter embodying this invention.

As shown in FIG. 1, a platen 3 for supporting the printing paper is provided in typewriter 1. The platen 3 is rotatable to allow feed of the paper. Carriage 7 is movable to a plurality of discrete positions along guide bar 5 arranged parallel to the platen 3. Print hammer 9 is mounted on the carriage 7. A font-wheel 11*a*, as part of a wheel cassette 11, and ribbon cassette 13, including a print ribbon 13*a*, are detachably installed on carriage 7. The operator can freely exchange font-wheel cassette 11 and ribbon cassette 13. This carriage 7 is fixed to a belt 17 with teeth which mesh with a gear of a carriage motor 15, and is reciprocated along the guide bar 5 by the belt 17, according to rotation of the carriage motor 15.

Moreover, the amount of incremental rotation of the carriage motor 15 is controlled according to the print pitch set by the operator. This print pitch is selectable, for example, from pica, elite, and micron by the operator.

Typewriter further has a keyboard 19. Print pitch changing switch 20 for setting the print pitch, ruled line mode set key 21 for setting the ruled line mode to print the ruled line, ruled line print key 22 for printing the ruled line, four cursor keys 23, print set keys 35, etc. are provided in keyboard 19. These cursor keys 23 make a print position move to the right and the left, up and down. For instance, the platen rotates in a positive direction and a form is advanced when the cursor key 23 for up direction is operated to print the next line of the form. Platen 3 rotates to the opposite direction and the form is retracted when cursor key 23 for down direction is operated to print on a previous line of the form. The carriage 7 is moved to the right when the cursor key 23 for the right direction is operated to move the print position to the right, and when the cursor key 23 for the left direction is operated to move the print position to the left, the carriage 7 is moved to the left. Therefore, if cursor keys 23 are operated, the relative position of carriage 7 and the form can be changed. Moreover, backing rush is corrected when the cursor key 23 for the left direction and the cursor key 23 for down direction are operated. Moreover, the print set key 25 is a key to make a point memory 31*a* of a RAM 31 (FIG. 4) memorize the relative position of carriage 7 and the form.

Next, a procedure for composing the ruled line print data will be explained with reference to FIG. 2. First, the ruled line mode set key 21 is operated and the typewriter is set in the ruled line mode. Next, a starting point X of the ruled line to be printed is stored in the point memory 31*a* by operating the point set key 25 after the print point is moved to the starting point X of the ruled line by operating cursor keys 23. And, an ending point Y is stored in the point memory 31*a* when the point set key 25 is operated after the printing point is similarly moved to an ending point Y located at a diagonal position from the starting point X, by operating the cursor key 23.

When the cursor keys 23 are operated, a unit amount of the carriage motion is equal to the print pitch set at that time, and a unit amount of the platen rotation is according to the one line paper feeding amount fixed in the ruled line mode, regardless of the print pitch.

The print data of the ruled line composed as mentioned above is printed in response to the operation of the ruled line print key 22.

The horizontal line type, O and the vertical line type, Q, each shown in FIG. 3 (A) and FIG. 3 (B), respectively, are formed on the font-wheel 11 installed on the carriage 7. A length of this horizontal line type 0 is equal to pica print pitch which is 1/10 inches and the maximum print pitch of all print pitches to be selected by the operator. The length of vertical line type 0 is equal to the paper feeding amount fixed in the ruled line mode.

Figure 4:
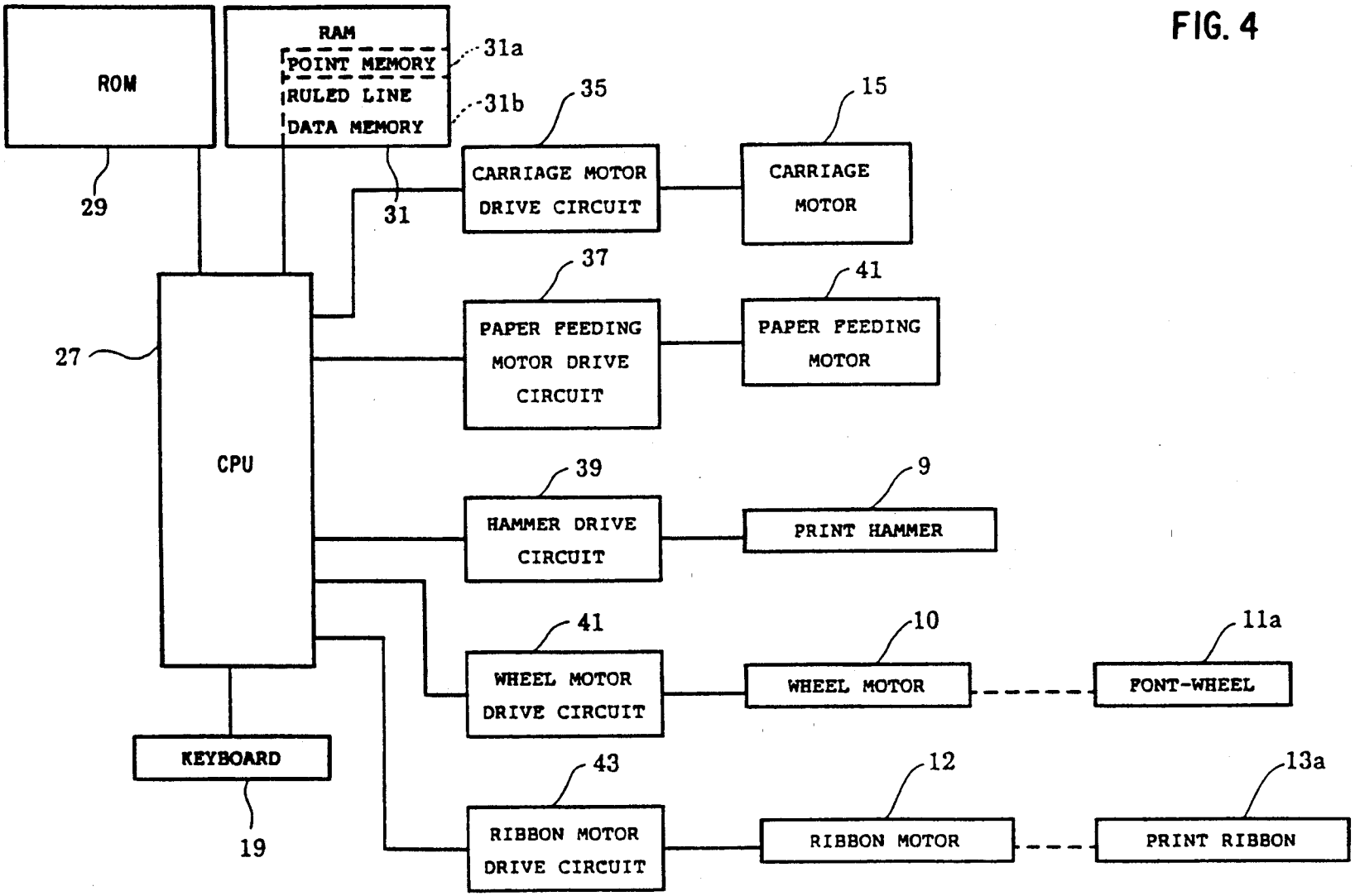
FIG. 4 is a block diagram showing the constitution of the control section.

Next, the constitution of the control section of the typewriter 1 of this invention will be described with reference to FIG. 4. ROM 29 memorizes the programs for controlling the movement of the typewriter 1, and RAM 31 memorizes the data input from the keyboard 19 etc. and works as a working memory; both are connected to CPU 27. CPU 27 controls movements of the typewriter 1 according to programs in the ROM 29. The ROM 29 memorizes the print pitch data to control the rotating amount of carriage motor 15 according to each of print pitches. The RAM 31 has a ruled line data memory 31*b*, in which input ruled line data for each line are stored in order. Moreover, carriage motor drive circuit 35 and paper feeding motor drive circuit 37 are connected to the CPU 27. Carriage motor 15, which drives the carriage 7, is connected to the carriage motor drive circuit 35 and paper feeding motor 41, which rotates the platen 3, is connected to the paper feeding motor drive circuit 37. A hammer drive circuit 39, which drives the print hammer 9, is connected to CPU 27. A wheel motor 10, which drives font-wheel 11*a*, is connected to a wheel motor drive circuit 41 and this wheel motor drive circuit 41 is connected to CPU 27. Ribbon motor 12 which makes the print ribbon 13*a* feed, is connected to ribbon motor drive circuit 43 and ribbon motor drive circuit 43 is further connected to CPU 27.

Figure 5:
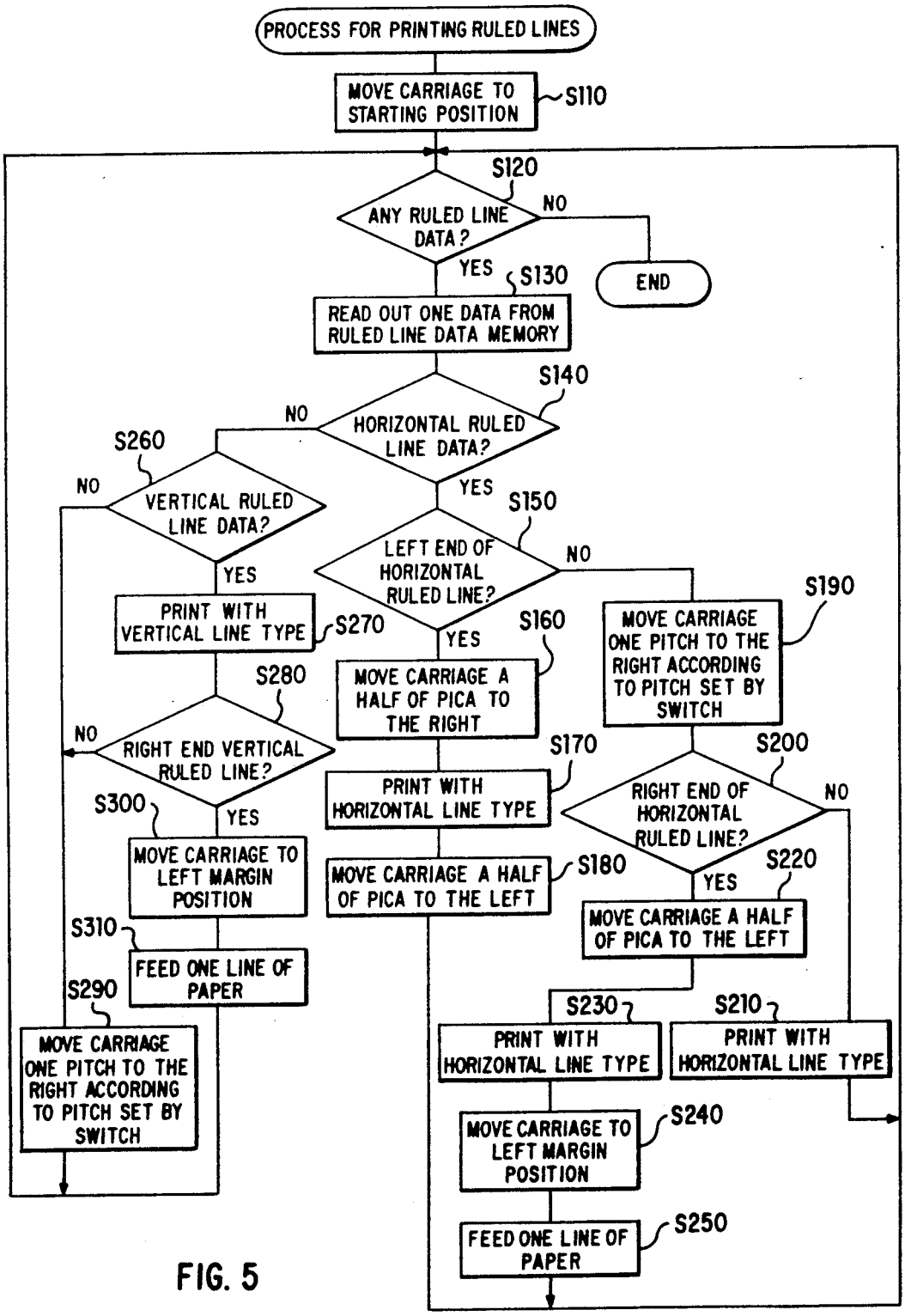
FIG. 5 is a flowchart showing operations of the control section.

Next, the process of the control part of typewriter 1, which is constituted as mentioned above, is explained according to the flowchart in FIG. 5.

When the ruled line print data to be printed is composed by above-mentioned procedure, the ruled line print key 22 is operated and the ruled line print processing starts.

First, at Step 110, carriage 7 is moved to the starting position X shown in FIG. 2. (Step is abbreviated in the following explanation and the drawing as S.) It is judged at S120 if the print data of the ruled line going to be printed is stored in the ruled line data memory 31*b* of the RAM 31, or not. When no data is stored in the ruled line data memory 31*b*, this processing is ended. If the ruled line print data is stored, S130 is followed. The data stored in the ruled line data memory 31*b* is read out one by one in order from the left end of the printing line at S130. And, it is judged at S140, if the data read out from the ruled line data memory 31*b* is the horizontal ruled line print data, or not. It is judged at S150 if the data read at S130 is a left end print data of the horizontal ruled line when, at S140, it is judged that the data is the horizontal ruled line print data. And, when it is judged that it is the data of the left end of the printing line at S150, the carriage 7 is moved a half of the pica pitch to the right at S160, and S170 is followed. At S170, the horizontal ruled line corresponding to only one printing motion with the horizontal line type is printed at the present position. At S180, carriage 7 is moved a half of the pica pitch to the left. Therefore, carriage 7 is returned to the position it occupied before the left end of the horizontal ruled line was printed. Moreover, the processing returns to S120 when the processing of S180 finishes.

On the other hand, the processing goes to S190 when it is judged that the data read at S130 is not the left end print data of the horizontal ruled line at S150. At S190, carriage 7 is moved one print pitch which was set by operation of the print pitch changing switch 20. Next, it is judged at S200 if the data is a right end print data of the horizontal ruled line. And, the processing goes to S210 when the data is not the right end print data of the horizontal ruled line. At S210, the horizontal ruled line corresponding to only one printing motion based on the horizontal line type is printed and the processing returns to S120. Moreover, if it is judged at S200 that the data is the right end print data of the horizontal ruled line, the processing goes to S220 and carriage 7 is moved a half of the pica pitch to the left. At S230, the horizontal ruled line corresponding to only one printing motion with the horizontal line type is printed at the present position. Then the carriage 7 is moved to the left margin position X at S240. And, the paper is fed by one line at S250 and the processing returns to S120.

On the other hand, the processing goes to S260 and it is judged if the data is the vertical ruled line print data when it is judged that the data read at S130 is not the horizontal ruled line print data at S140. When it is judged at S260 that the data read from the ruled line data memory 31*b* is the vertical ruled line print data, S270 is followed. At S270, the vertical ruled line corresponding to only one printing motion with the vertical line type is printed at the present position. Next, it is judged at S280 if the data read at S130 is a right end print data of the vertical ruled line or not. In case that the data is not the right end print data of the vertical ruled line, S290 is followed. At S290 carriage 7 is moved by one print pitch which was set by operation of the print pitch changing switch 20, then the processing returns to S120.

However, when it is judged that it is the data of the right end print data of the vertical ruled line at S280, S300 is followed and carriage 7 is returned to the left margin position X. And, at S310, the paper feeding by one line is done and the processing returns to S120. Moreover, when at S260 it is judged that the data read from the ruled line data memory 31*b* is not the vertical ruled line print data, the processing goes to S290. At S290 carriage 7 is moved by one print pitch which was set by operation of the print pitch changing switch 20 of the typewriter 1 and the processing returns to S120.

As mentioned above, in the ruled line mode printed by this typewriter 1, whatever print pitch is set, or even if a type wheel for maximum print pitch is installed on the carriage 7, the horizontal ruled line does not protrude from the vertical ruled line composing the outline. FIG. 6(A) shows printing done by the type for pica, which is a maximum print pitch. That is FIG. 6 (A) shows the ruled line print by this typewriter 1 when the print pitch is set as pica and FIG. 6 (B) shows the ruled line printed by this typewriter 1 when the print pitch is set as micron. "P" shows width of pica print pitch and "M" shows width of micron print pitch in these Figures. As shown in FIG. 6 (A), FIG. 6(B), "X" is a position where the edge of the horizontal ruled line is shown. As shown in these Figures the left end of the horizontal line is printed at a position which is shifted right by one half the pica print pitch, regardless of print pitch which was set by operation of the print pitch changing switch. Therefore, the center of the horizontal line type is put on the position of "X". Therefore, the length of left half of horizontal line type for pica and a distance from the position shown by "Z" to the vertical ruled line located at the left end are equal and the horizontal ruled line does not protrude from the vertical ruled line located at the left end. And, when the ruled line is printed in positions between the edges, whatever print pitch is set, the segment is connected and does not become a dotted line, because the horizontal line type is of maximum print pitch.

What is claimed is:

1. A printing apparatus for printing plural ruled lines on a print medium comprising:
   - a print pitch selecting means for selecting one print pitch from plural print pitches;
   - a carriage movable along a print line;
   - a detachable unit line element mounted on the carriage, said unit line element being adapted to print a ruled line by printing plural unit lines as the carriage is moved along the print line;
   - a carriage drive means for moving the carriage according to the print pitch selected by the print pitch selecting means;
   - a positioning means for positioning the unit line element to a print position for printing the ruled line on the print medium by controlling said carriage drive means; and
   - a control means for operating the positioning means and printing the unit line comprising an end portion of said ruled line after the carriage is moved a half print pitch of a maximum print pitch of said plurality of pitches toward the middle of said ruled line, regardless of a print pitch selected by the print pitch selecting means, when an end of the ruled line is printed.

2. Apparatus as in claim 1, wherein said detachable unit line element is a discrete printing element.

3. Apparatus as in claim wherein the unit line element is an element of a type font.

4. Apparatus as in claim 3, wherein said type font comprises a print wheel.

5. Apparatus as in claim 1, wherein said detachable unit line element is of a pitch corresponding to one of said plural print pitches.

6. Apparatus as in claim 2, and further comprising:
   - pressing means for pressing the type toward a printing position.

7. Printing apparatus comprising:
   - means for supporting a print medium;
   - a carriage movable along a print line;
   - a selecting means for selecting one of a plurality of print pitches;
   - a carriage drive means for moving the carriage at a print pitch selected by said selecting means along said print line;
   - unit line printing means mounted on the carriage for printing a line on said print medium by printing plural unit lines; and
   - a control means for positioning the carriage at locations spaced by a distance one half a maximum pitch selectable by said selecting means when ends of the line are being printed by said unit line printing means irrespective of the pitch selected by said selecting means.

8. Apparatus as in claim 7, wherein the unit line printing means is an element of a type font.

9. Apparatus as in claim 8, wherein said type font comprises a print wheel.

10. Apparatus as in claim 7, wherein the unit line printing means includes a type element detachably mounted on the carriage and means for pressing the type element toward the print medium.

11. Apparatus as in claim 10, wherein the length of said detachable type element corresponds to one of said plural print pitches.

12. A printing apparatus comprising:

an input means for inputting horizontal ruled line data;

a memory means for storing said ruled line data;

a printing means movable along a print line for printing a ruled line according to the ruled line data;

a moving means for moving said printing means along said print line at a plurality of selectable pitches;

a control means for reading said stored ruled line data and for controlling said printing means to print a ruled line according to said stored ruled line data; and said control means including means for positioning said printing means at locations spaced by one half the length of the maximum selectable print pitch from each end of the ruled line corresponding to said ruled line data in said memory means, irrespective of the print pitch selected.

13. Apparatus as in claim 12, wherein said printing means includes a unit printing element for printing the unit line on a print medium as the printing means moves along said print line, thereby forming the ruled line of a plurality of said unit lines.

14. Apparatus as in claim 12, wherein the unit printing element is a unit line type element.

15. Apparatus as in claim 14, wherein the printing means includes means for detachably mounting said unit line type element.

16. Apparatus as in claim 15, wherein the unit line element is an element of a type font.

17. Apparatus as in claim 16, wherein the type font comprises a print wheel.

18. Apparatus as in claim 17, and further comprising a type font cassette and wherein the print wheel containing the type font is mounted within the type font cassette.

19. Apparatus as in claim 15, wherein the length of said unit line type element corresponds to one of said plural print pitches.

* * * * *